United States Patent [19]

Fuzzell

[11] Patent Number: 4,494,096

[45] Date of Patent: Jan. 15, 1985

[54] LATCHING SOLENOID

[75] Inventor: Joe E. Fuzzell, Peoria, Ill.

[73] Assignee: Caterpillar Tractor Co., Peoria, Ill.

[21] Appl. No.: 608,597

[22] Filed: May 9, 1984

[51] Int. Cl.[3] ..... H01H 9/20

[52] U.S. Cl. ..... 335/170; 335/171; 335/253

[58] Field of Search ..... 335/167, 168, 170, 171, 335/253, 254

[56] References Cited

U.S. PATENT DOCUMENTS

| | | | |
|---|---|---|---|
| 1,326,359 | 12/1919 | Mahoney | 335/254 |
| 2,853,658 | 9/1958 | Lindenberg | 335/254 |
| 3,201,545 | 8/1965 | Kruzic | 335/165 |
| 2,632,821 | 3/1953 | Wright et al. | 200/98 |
| 3,893,053 | 7/1975 | Onatsevich | 335/254 |

FOREIGN PATENT DOCUMENTS

| | | | |
|---|---|---|---|
| 1175892 | 4/1959 | France | 335/253 |

*Primary Examiner*—George Harris
*Attorney, Agent, or Firm*—Terry D. Morgan

[57] ABSTRACT

A latching solenoid has a first inductive coil for selectively positioning a member at a preselected location where it is locked against longitudinal movement by a mechanical latching means. The latching means includes a plunger moveable within a bore and positionable within a bifurcated end portion of the member. Inserting the plunger into the member radially expands the bifurcated end portion, capturing the end portion between the plunger and bore wall. A second inductive coil selectively withdraws the plunger from the bifurcated end portion, releasing the member from the latched position. Each of the coils is required to be energized only momentarily, thereby avoiding problems associated with constantly energized solenoids (e.g. heat dissipation, life expectancy, size, etc.).

15 Claims, 5 Drawing Figures

10
14
18
40
36
16
15
13
38
12
20
19
R
C
OFF
ON
ST.
S
B
32
34
30
27
28
29
22
24
26
17

LATCHING SOLENOID

TECHNICAL FIELD

This invention relates generally to a solenoid and, more particularly, to a device for latching a solenoid in a preselected position.

BACKGROUND ART

In the field of spark ignited engines, a loss of electric power necessarily results in a cessation of spark and correspondingly, the engine discontinues operation. For example, operation of the key switch in an automobile to the "off" position interrupts electric power causing the engine to stop. However, there are a group of engines (e.g., diesel, turbine, etc.) whose continued operation is independent of the electric system. That is to say, after a suitable starting period the combustion process is self sustaining and absent mechanical failure, the continued supply of fuel will maintain the engine in an operating mode.

From this description it becomes obvious that one method of operator intervention for shutting down an engine would be to discontinue the supply of fuel. There are two well established methods of providing this function, both of which employ an electrically operated solenoid to actuate the rack of the fuel system to a detent position, where the fuel supply is interrupted. The electric solenoid provides a means for shutting down the engine which appears similar to the well accepted method employed by the automotive industry, where operation of the ignition switch to the "off" position shuts down the engine.

The first of these methods uses what is called an energized to run solenoid. Electric power is continuously supplied to the solenoid while operation of the engine is desired, allowing the supply of fuel to continue. At such time as when the operator desires to shut down the engine, deactivating the key switch shuts off power to the solenoid which discontinues the supply of fuel. Clearly, this system does have some inherent disadvantages. For example, in the operation of construction equipment, an electrical failure for any reason results in the engine being shut down with no capability for restarting or driving the vehicle to a service area. Additionally, constant energization during operation requires that the solenoid be constructed more ruggedly than a solenoid which is actuated intermittently. A constantly energized solenoid would require more heat dissipation and inductive coils capable of carrying current for longer periods of time and withstanding additional heat.

The second method employs a system called an energized to shut down solenoid. This system supplies electric power to a solenoid for a predetermined amount of time upon deactivating the key switch. Energizing the solenoid results in the fuel supply being shut off for a predetermined amount of time to insure that the engine has been shut down. While this system overcomes the disadvantages associated with constantly energized solenoids, it does suffer from problems unique to its own construction. For example, loss of electric power does not provide the operator with the ability to shut down the engine and the actuation of the solenoid for a predetermined amount of time does not assure that the engine is shut down. Additionally, the electrical circuitry required to provide power for a predetermined time period has proven to be a costly addition.

The present invention is directed to overcoming one or more of the problems as set forth above.

DISCLOSURE OF THE INVENTION

In accordance with one aspect of the present invention, a latching solenoid has a body, a member, a plunger, means for moving the plunger, and means for moving the member. The body has first and second end portions and a bore extending therethrough. The bore has first and second portions adjacent the first and second end portions, respectively. The member has a bifurcated end portion and is moveable within the bore between a first position, at which the bifurcated end portion is adjacent the tapered portion of the bore, and a second position, at which the bifurcated end portion is adjacent the second portion of the bore. The plunger has an end portion and is moveable between a first position, at which the end portion is in contact with one of the bore and the bifurcated end portion of the member, and a second position, at which the end portion of the plunger is spaced from the bore and the member.

BEST MODE FOR CARRYING OUT THE INVENTION

Figure 1:
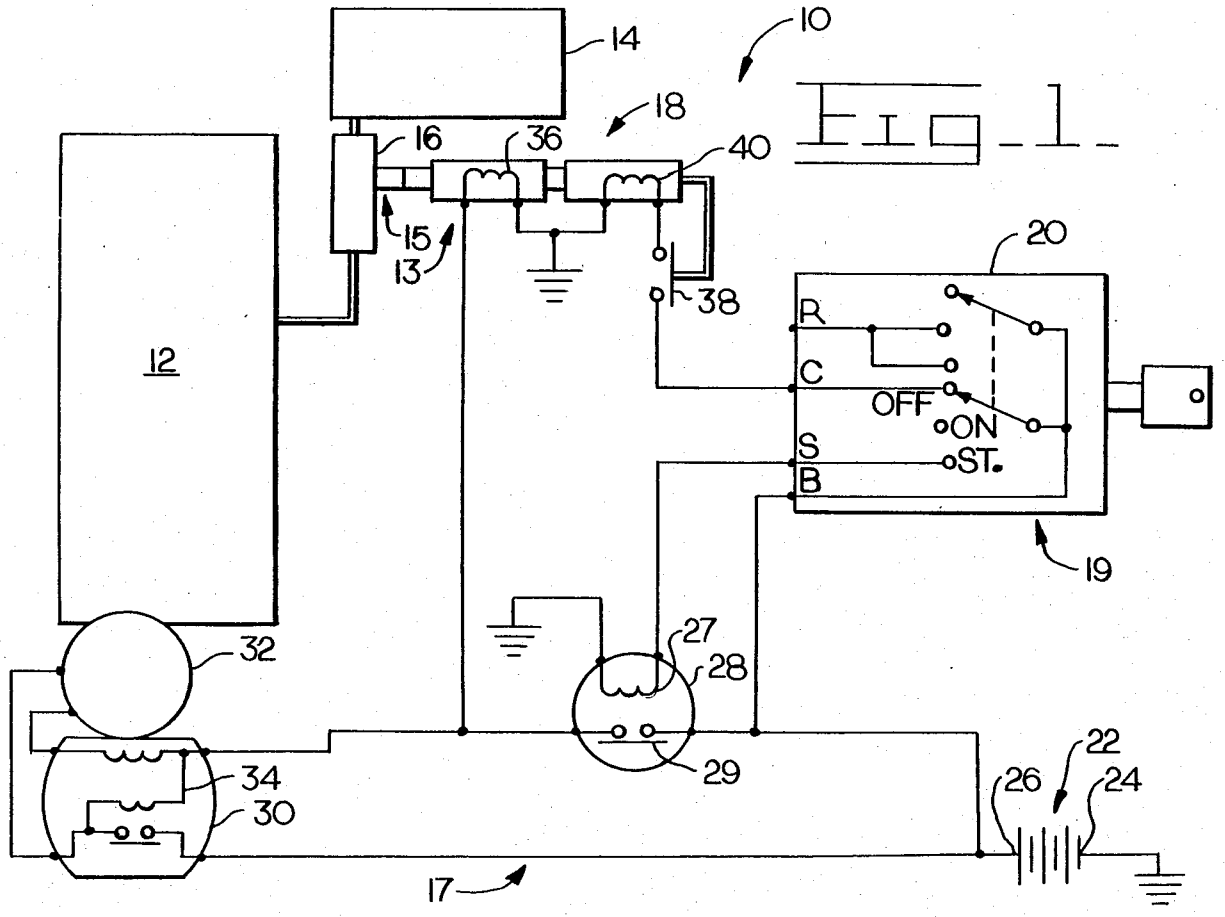
FIG. 1 illustrates a block diagram of the present invention shown in a fuel regulating system for a prime mover.

Referring now to the drawings, wherein a preferred embodiment of the present apparatus 10 is shown, FIG. 1 illustrates an apparatus 10 for enabling and disabling a prime mover 12 by controlling a supply of fuel from a tank 14, through a fuel injection pump 16, and finally to the prime mover 12. A detailed description of the fuel injection pump 16 will not be included as those skilled in the art recognize that these devices are commercially available. It is sufficient to be aware that the pump 16 has a rack and operation of the rack regulates the fuel supply such that movement of the rack to a detented position terminates the supply of fuel to the prime mover 12.

Further shown in FIG. 1 is an electrical system 17 for operating a latching solenoid 18 and providing an actuation means 13 for moving the rack to and from the detented position. The electrical system 17 includes a three position switching means 19, preferably an ignition switch 20 operable to any of the three positions "OFF", "ON", or "START". Three electrical terminals B,S,C are located external the ignition switch 20 and associated with the three positions, respectively. A battery 22 has a negative terminal 24 connected to ground and a positive terminal 26 connected to the terminal B, a contactor portion of a relay 28, and a solenoid 30 of a starter 32. The relay 28 receives power to its inductive coil from the terminal S of the ignition switch 20. The contactor portion of the relay 28 is further connected to inductive coils 34, 36 in both the starter solenoid 30 and the latching solenoid 18. A contact 38 is located intermediate the terminal C and an inductive coil 40 and provides power to the coil 40 when the ignition switch 20 is moved to the "OFF" position. Energizing the coil 40 necessarily results in operation of the latching solenoid to the detented position and; correspondingly, the contact 38 is opened. A detailed description of the interaction of the components necessary to operate the contact 38 will be described in greater detail later in the text.

Figure 2:
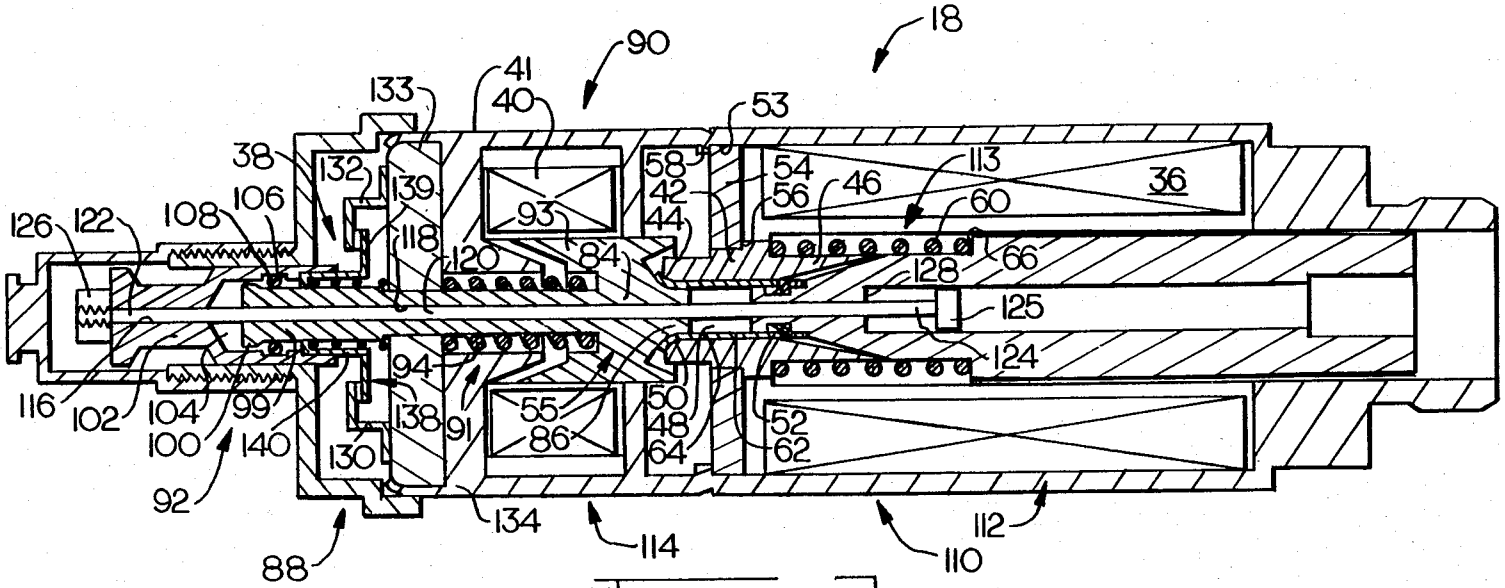
FIG. 2 illustrates a diagrammatic view of the present invention in a first operating position.

FIG. 2 shows an embodiment of the latching solenoid 18 which has, in addition to an outer casing 41, a body 42 has first and second end portions 44, 46 and a bore 48 extends therethrough. The bore 48 has first and second portions 50, 52 adjacent the first and second end portions 44, 46, respectively. The body 42 is fixed against axial motion relative to the outer casing 41 by, for example, an annular ring 54 which extends about the outer periphery of the body 42 and contacts a shoulder portion 56 of the body 42. The outer edge 53 of the ring 54 rests against a protrusion 58 extending radially inward from the outer casing 41. A latching means 55 is formed from the first portion 50 of the body 42 in conjunction with a first end portion 86 of a plunger 84 and a bifurcated end portion 64 of a member 62.

Figure 3:
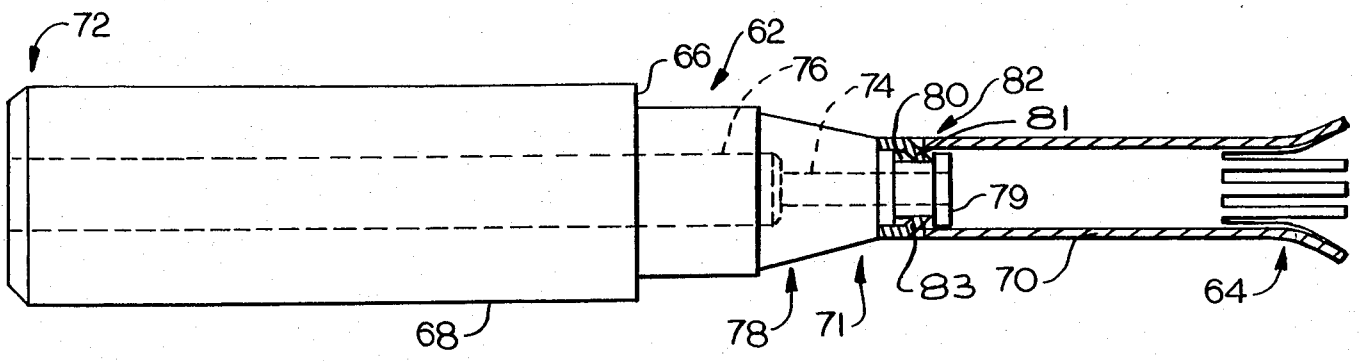
FIG. 3 illustrates a diagrammatic view of a portion of the present invention.

The member 62 has a bifurcated end portion 64 (best shown in FIG. 3), and is moveable within the bore 48 between a first position, at which the bifurcated end portion 64 is adjacent the tapered portion 50 of the bore 48, and a second position at which the bifurcated end portion 64 is adjacent the second portion 52 of the bore 48. The member 62 has a shoulder portion 66 in contact with a coil spring 60. The spring 60 is disposed about the body 42, contacts the shoulder portion 56, and provides a biasing force tending to separate the body 42 and member 62. The member 62 consists of a rod 68 and sleeve 70 pivotally connected together at their respective end portions. The rod 68 has first and second end portions 71, 72, a first bore 74 adjacent said first end portion 71, and a second bore 76 coaxially interconnecting the first bore 74. The diameter of the second bore 76 is larger than the diameter of the first bore 74. The rod 68 has a frustoconical portion 78 adjacent the first end portion 71. Immediately adjacent the frustoconical portion 78 is a cylindrical portion 79 which has a diameter smaller than the inner diameter of the sleeve 70. The sleeve 70 fits loosely about the cylindrical portion 79 allowing restricted pivotal motion between the rod 68 and sleeve 70. A pair of tabs 81, 83 are disposed adjacent the first end portion 71 of the sleeve 70 and can be bent radially inward to fit within an annular recess 80 in the cylindrical portion 79, preventing separation of the rod 68 and sleeve 70. In the operation of the latching solenoid 18, pivotal movement of the sleeve 70 allows the latching action to occur under slight misalignment of the aforementioned parts.

The plunger 84 has a first end portion 86 and is moveable between a first position at which the first end portion 86 is in contact with one of the first portion 50 of the bore 48 and the bifurcated end portion 64 of the sleeve 70, and a second position at which the tapered portion 86 is spaced from the bore 48 and the sleeve 70. The plunger 84 is located along the central axis of the body 42 and is axially moveable within the tapered portion 50 of the bore 48. First means 88 for controllably moving the plunger 84 between the first and second positions includes both a first electromagnetic means 90 and a first manual means 92. The first electromagnetic means 90 includes the inductive coil 40, an armature 93 disposed about and connected to the plunger 84, and a first biasing means 91 which includes a coil spring 94 disposed about the plunger 84 and seated against the armature 93. The coil spring 94 acts against the armature 93 to urge the plunger 84 in a direction toward the first position. Energizing the inductive coil 40 provides a force sufficient to overcome the force exerted by the spring 94; consequently, the plunger 84 is moved toward the second position. The manual device 92 includes a second end portion 99 of the plunger 84 having an annular protrusion 100 extending outwardly from the plunger 84. A handle 102 has a first bore 104 for receiving the plunger second end portion 99 and an annular groove 106 extending about the periphery of the first bore 104. An elastomeric ring 108 is disposed within the annular groove 106. Manually moving the handle causes the ring 108 to engage the annular protrusion 100 and moves the plunger 84 in a direction toward the second position.

Similarly, the latching solenoid 18 also has second means 110 for controllably moving the member 62 between its first and second positions. The second means 110 includes a second biasing means 113 comprised of the previously discussed coil spring 60 for moving the member 62 in a direction toward its second position and a second electromagnetic means 112 which includes an inductive coil 36 disposed about a portion of the body 42 and the member 62. Energizing the inductive coil 36 generates a magnetic force on the member 62 sufficient to overcome the spring force and move the member 62 toward its first position where the bifurcated end portion 64 of the sleeve 70 is forced between the first portions 86, 48 of the plunger 84 and the bore 50.

A second manual means 114 is additionally provided for moving the member 62 in a direction toward its first position. The handle 102 and plunger 84 each have a bore 116, 118 extending axially therethrough in general alignment with the bores 74, 76 of the member 62. A cable 120 has first and second end portions 122, 124 and extends through the bores 116, 104, 118, 74, 76 of the handle 102, plunger 84, and member 62. A first stop 125 has a diameter greater than the diameter of the first bore 74 of the member 62 and is connected to the second end portion 124 of the cable 120 and disposed within the second bore 76 of the member 62. A second stop 126 has a diameter greater than the diameter of the handle bore 116 and is connected to the first end portion 122 of the cable 120, such that manually operating the handle 102 by pulling with sufficient force causes the elastomeric ring 108 to radially expand over the plunger annual protrusion 100 and free the handle 102 from the plunger 84. Continued operation of the handle 102 results in the second stop 126 contacting the handle 102, the first stop 125 contacting a shoulder 128 formed by the coaxial intersection of the member first and second bores 74, 76, and urging the member 62 toward its first position.

Figure 4:
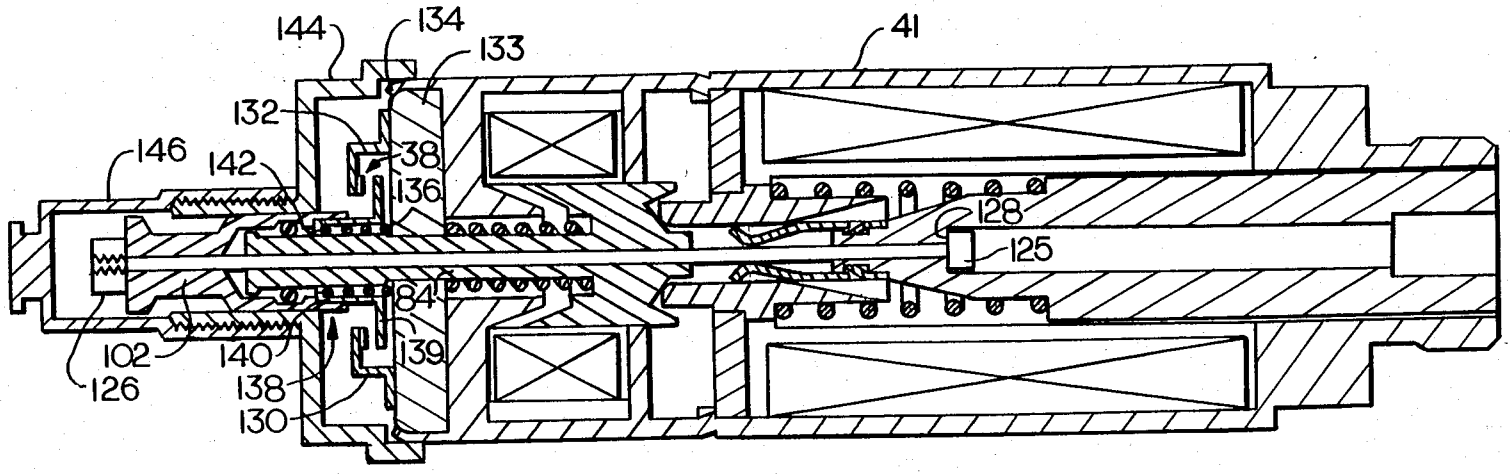
FIG. 4 illustrates a diagrammatic view of the present invention in a second operating position.

The second manual means 114 also provides the previously mentioned function of opening the contact 38 in response to movement of the member 62 to the detent position, as shown in FIG. 4. A pair of contact terminals 130, 132 of the contactor 38 are connected to a plug 133 formed from an electrically insulative material which is fixedly connected to an end portion 134 of the outer casing 41. A second portion 138 of the contactor 38 is a metallic disk 139 having a raised center portion 140 with an opening 142 extending therethrough. The plunger 84 passes through the opening 142 and has its second end portion 99 formed from an electrically insulative material to prevent the contactor 38 from being shorted to ground. A coil spring 136 is disposed within the raised center portion 140 about the plunger 84, extends to the end portion 134 of the outer casing 41, and urge the disk 139 against the contact terminals 130, 132. The handle 102 contacts the raised center portion 140, such that moving the plunger 84 (electromagnetically or manually) to free the member 62 results in the first and second stops 125, 126 contacting the shoulder 128 and handle 102, compressing the coil spring 136, and opening the contactor 38. Further, the second stop 126 is threadably engaged with the rod 120 allowing a certain amount of adjustability to insure that the length of the rod 120 between the stops 125, 126 is sufficient to allow the member 62 to move to its second position and open the contactor 38. A cover 144 and threadably engaged cap 146 are connected to the end portion 134 of the outer casing 41 to prevent the intrusion of dust and moisture into the latching solenoid 18. Access to the handle 102 can be gained by removing the cap 146 from the cover 144. The cover 144 and cap 146 are preferably formed from an injection molded plastic.

Figure 5:
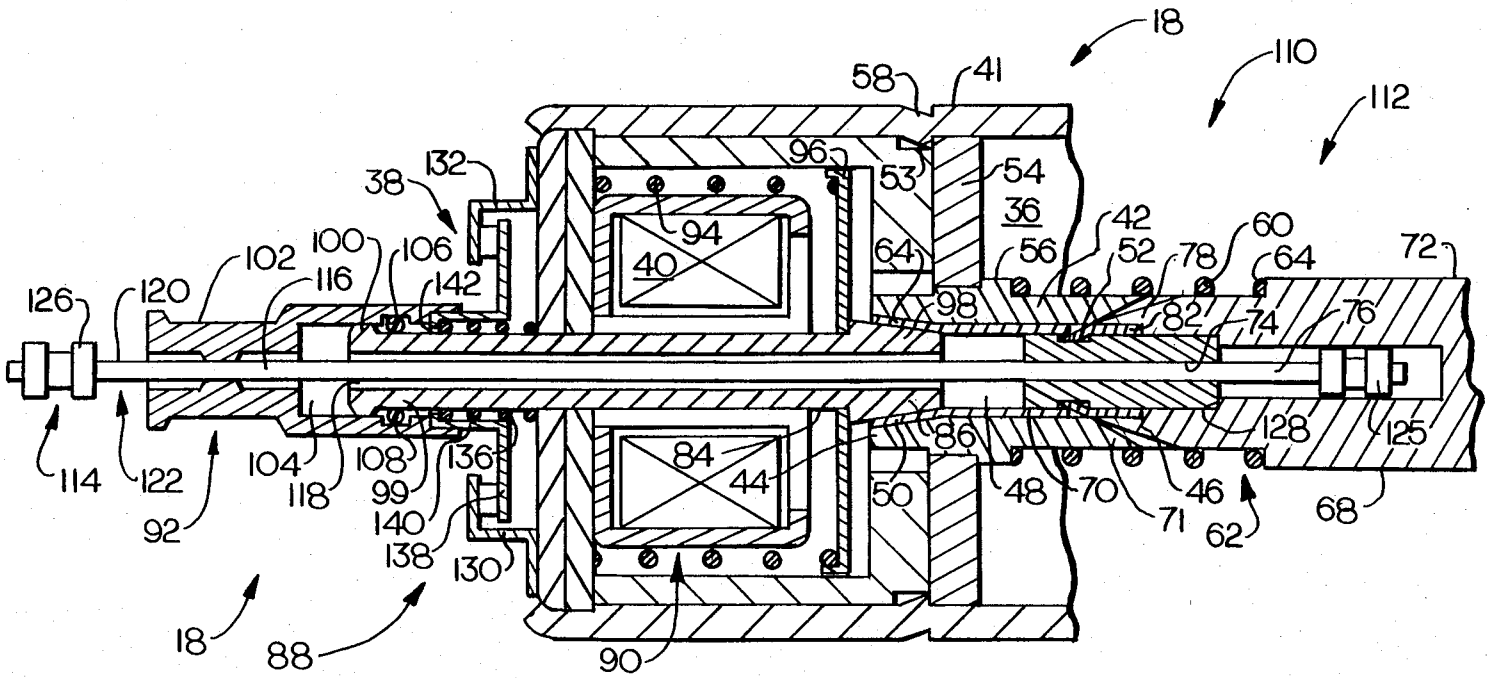
FIG. 5 illustrates an alternate embodiment of the present invention.

FIG. 5 illustrates an alternate embodiment of the present invention which differs primarily in the formation of the first portions 86, 50 of the plunger 84 and bore 48 of the body 42. Both of these portions 86, 50 are similarly tapered in a complementary fashion where the angles of inclination are sufficiently similar to provide a snug fit between the plunger 84 and body 42. Tapering the first portions 86, 50 provides a larger surface contact area requiring greater frictional forces to be overcome to force the sleeve 70 from between the plunge bore 84. Additionally, forces normal to the tapered portions 86, 50 have components of force along the longitudinal axis which must also be overcome.

INDUSTRIAL APPLICABILITY

In the overall operation of a work vehicle and the latching solenoid 18, assume that the operator is attempting to start the vehicle by operating the three position ignition switch 20 to the start position. Power from the battery 22 is connected through the ignition switch 20 to the inductive coil 27 of the relay 28 closing the contacts 29 of the relay 28 and, subsequently, supplying power through the contacts 29 to both the starter solenoid 30 and the inductive coil 36 of the latching solenoid 18. Engagement and rotation of the starter 32 is initiated while the member 62 is moved to its first position and latched by the plunger 84. With the member 62 at its first position, fuel is free to flow through the fuel injection pump 16, and starting of the engine is possible.

At some future time, the operator will inevitably desire to shut down the engine. Operation of the ignition switch 20 to the "off" position connects battery voltage through the contactor 38 and inductive coil 40. Energizing the coil 40 moves the plunger 84 toward its first position releasing the bifurcated end portion 64 of the sleeve 70 and freeing the member 62 to be moved by the coil spring 60 to its second position and interrupt the supply of fuel to the engine. The moving member 62 contacts the first stop 125, pulls the cable 120 through the bores 116, 104, 118, 74, 76 and causes the second stop 126 to contact the handle 102 and compress the coil spring 136. Movement of the handle 102 separates the contactor 38 and discontinues the supply of power to the inductive coil 40. In this way, the coil 40 is energized only momentarily and avoids the use of a timing mechanism to insure that the engine is actually stopped. The coil 40 will be energized until the member 62 has moved to its second position. This interaction guarantees that electric power is provided until the fuel supply is cut off.

In the case of a diesel powered vehicle, the latching action of the solenoid 18 insures that the engine will continue to operate irrespective of a loss of electric power. However, in the absence of electric power, movement of the ignition switch 20 to the "off" position will not energize the coil 40 and free the member 62 to move to its second position. Manual operation of the handle 102 allows the operator to shut down the engine by simply pulling the handle 102.

In the event that electrical failure is limited to the inductive coil 36 or associated wiring, such that when attempting to start the engine the member 62 does not move to its first position, a second manual means 114 is provided for moving the member 62 to its latched position. Pulling the handle 102 further to a second position latches the member 62 at its first position.

Other aspects, objects and advantages of this invention can be obtained from a study of the drawings, the disclosure, and the appended claims.

I claim:

1. A latching solenoid, comprising:

a body having first and second end portions and a bore extending therethrough, said bore having first and second portions adjacent said first and second end portions, respectively;

a member having a bifurcated end portion and being moveable within said bore between a first position, at which said bifurcated end portion is adjacent said first portion of said bore, and a second position, at which said bifurcated end portion is adjacent said second portion of said bore;

a plunger having a first end portion and being moveable between a first position at which said first end portion is in contact with one of said first portion of said bore and said bifurcated end portion of said member, and a second position, at which said first end portion of said plunger is spaced from said bore and said member;

first means for controllably moving said plunger between said first and second positions; and second means for controllably moving said member between said first and second positions.

2. A latching solenoid, as set forth in claim 1, wherein said first end portion of said plunger and said first portion of said bore are tapered.

3. A latching solenoid, as set forth in claim 1, wherein said means for moving said plunger includes a first electromagnetic means for controllably exerting a force on said plunger in a direction toward said second position and a biasing means for urging said plunger toward said first position.

4. A latching solenoid, as set forth in claim 3, including a three position switching means for delivering a first signal in response to positioning said switching means at a first position; and, wherein said first electromagnetic means exerts said force on said plunger in response to receiving said first signal.

5. A latching solenoid, as set forth in claim 1, wherein said second means for moving said member includes a second electromagnetic means for controllably exerting a force on said member in a direction toward said first position and a second biasing means for urging said member toward said second position.

6. A latching solenoid, as set forth in claim 5, including a three position switching means for delivering a second signal in response to positioning said switching means at said second position; and, wherein said second electromagnetic means exerts said force on said member in response to receiving said second signal.

7. A latching solenoid, as set forth in claim 1, wherein said plunger has a second end portion with an annular protrusion extending outwardly from said second end portion;

a handle having a first bore receiving said plunger second end portion and an annular groove extending about the periphery of said first bore; and an elastomeric ring positioned within said annular groove.

8. A latching solenoid, as set forth in claim 7, wherein said plunger includes a bore extending through said plunger first and second end portions, and said handle having a second bore extending therethrough;

said member having first and second end portions, a first bore adjacent said first end portion, and a second bore coaxially interconnecting said first bore and having a diameter greater than the diameter of said first bore; and including a cable having first and second end portions, said cable extending through said bores of said plunger, said body, said member, and said handle;

a first stop having a diameter greater than the diameter of the first bore of said member and being connected to the second end portion of said cable and disposed within the second bore of said member; and a second stop connected to said first end portion of said cable and having a diameter greater than the diameter of said handle second bore.

9. A latching solenoid, as set forth in claim 8, wherein said member includes a rod having first and second end portions, said first end portion having a shoulder portion extending about the outer periphery, and wherein said first bore of the member extends into said rod first end portion;

a sleeve having first and second end portions, said first end portion being bifurcated and said second end portion extending about and being connected to said first end portion of said member;

said body having a shoulder portion extending about the outer periphery; and a coil spring disposed about said rod and said body and contacting said shoulder portions of said body and said rod, respectively.

10. A latching solenoid, as set forth in claim 9, wherein said sleeve is pivotally connected to said first end portion of said rod.

11. A latching solenoid for controllably discontinuing the supply of fuel to a prime mover, comprising:

actuator means for movement between a first position for interrupting said supply of fuel to said prime mover and a second position for maintaining said supply of fuel to said prime mover, said actuator means being biased in a direction toward said first position;

latching means for controllably maintaining said actuator means in said second position;

a three position switching means for delivering first and second signals in response to positioning said switching means at respective first and second positions;

first electromagnetic means for freeing said actuator means for movement toward said first position in response to receiving said first signal;

second electromagnetic means for moving said actuator means from said first position to said second position in response to receiving said second signal; and first manual means for releasing said latching means in response to movement of said first manual means to a first preselected position and for moving said actuator means from said first position to said second position in response to movement of said first manual means to a second preselected position.

12. A latching solenoid, as set forth in claim 11, including second manual means for interrupting delivery of said first signal in response to movement of said actuator means toward said first position.

13. A latching solenoid, as set forth in claim 11, wherein said latching means includes:

a body having a bore extending therethrough, said bore having first and second portions;

a member having a bifurcated end portion, said member being moveable between a first position at which said bifurcated end portion is disposed within said first portion of said bore and a second position where said bifurcated end portion is spaced from said first portion or said bore;

a plunger having a first end portion, said plunger being moveable between a first position at which said first end portion of said plunger is in contact with one of said first portion of said bore and said bifurcated end portion of said member and a second position at which said plunger is spaced from said bore and said member.

14. A latching solenoid, as set forth in claim 13, wherein said first manual means includes a handle having a first bore extending therein, said first bore having an annular groove extending about the periphery of said bore;

said plunger having a second end portion with an annular protrusion extending radially from said plunger, said second end portion being disposed within said bore of said handle; and an elastomeric ring positioned within said annular groove of said bore.

15. An apparatus, comprising:

a prime mover;

a fuel injection pump having a rack moveable between a first position, at which said pump discontinues supplying fuel to said prime mover, and a second position, at which said pump continues supplying fuel to said prime mover;

a three position switching means for delivering first and second signals in response to positioning said switching means at respective first and second position;

a body having first and second end portions and a bore extending therethrough, said bore having first and second portions adjacent said first and second end portions, respectively;

a member having first and second end portions, said first end portion being bifurcated and said second end portion being connected to said rack, said member being moveable between a first position, at which said bifurcated end portion is disposed within and contactable with the first portion of said bore and said rack is biased to the second position by said second end portion, and a second position, at which said bifurcated end portion is disposed within the second portion of said bore and said rack is biased to the first position by said second end portion;

a plunger having first and second end portions, said second end portion having an annular protrusion extending outwardly from the plunger, said plunger being moveable between a first position, at which the first end portion of said plunger is in contact with one of the first portion of said bore and the bifurcated end portion of said member, and a second position, at which the first end portion of said plunger is spaced from said bore and said member;

a first electromagnetic means for exerting a magnetic force on said plunger in a direction toward the second plunger position in response to receiving said first signal;

first biasing means for urging said plunger in a direction toward the first plunger position;

a second electromagnetic means for exerting a magnetic force on said member in a direction toward the first member position in response to receiving said second signal; and second biasing means for urging said member in a direction toward the second member position.

* * * * *